US007339548B2

(12) United States Patent
Cislo

(10) Patent No.: US 7,339,548 B2
(45) Date of Patent: Mar. 4, 2008

(54) MOUNTABLE AND ADJUSTABLE AERODYNAMIC ANTENNA APPARATUS AND METHOD

(75) Inventor: Donald M. Cislo, Glendale Heights, IL (US)

(73) Assignee: Antenex, Inc., Glendale Heights, IL (US)

( * ) Notice: Subject to any disclaimer, the term of this patent is extended or adjusted under 35 U.S.C. 154(b) by 56 days.

(21) Appl. No.: 11/390,599

(22) Filed: Mar. 28, 2006

(65) Prior Publication Data

US 2007/0229375 A1 Oct. 4, 2007

(51) Int. Cl.
*H01Q 1/12* (2006.01)
*H01Q 3/02* (2006.01)
*H01Q 1/32* (2006.01)

(52) U.S. Cl. ..... 343/878; 343/882; 343/711; 343/713; 343/715

(58) Field of Classification Search ..... 343/711, 343/713, 715, 878, 882
See application file for complete search history.

(56) References Cited

U.S. PATENT DOCUMENTS 2,299,785 A 10/1942 Barrett
3,138,661 A 6/1964 Grashow
3,666,902 A 5/1972 Owen et al.
4,115,779 A * 9/1978 Dantzler et al. ..... 343/715
4,243,989 A 1/1981 Piper
4,282,526 A 8/1981 Alf et al.
5,166,695 A 11/1992 Chan et al.
5,184,142 A 2/1993 Hornburg et al.
6,236,377 B1 5/2001 Hussaini et al.
6,657,589 B2 12/2003 Wang et al.
6,930,643 B2 * 8/2005 Byrne et al. ..... 343/702

* cited by examiner

*Primary Examiner*—H. Nguyen
*Assistant Examiner*—Robert Karacsony
(74) *Attorney, Agent, or Firm*—Harness, Dickey & Pierce, P.L.C.

(57) ABSTRACT

Exemplary embodiments of mountable and adjustable antenna apparatuses and methods are disclosed. In one exemplary embodiment, a mountable and adjustable antenna apparatus includes a top housing member, a bottom housing member, and an antenna assembly being disposed within the top housing member. The top housing member is in rotatable relation to the bottom housing member. The antenna assembly is in fixed relation to the top housing member. The top housing member has an aerodynamic configuration for reducing drag on, and for eliminating fatigue as well as flutter of, the antenna assembly.

28 Claims, 2 Drawing Sheets

MOUNTABLE AND ADJUSTABLE AERODYNAMIC ANTENNA APPARATUS AND METHOD

TECHNICAL FIELD

The present invention relates to antenna apparatuses and methods. More particularly, the present invention relates to antenna apparatuses and methods for vehicles. Even more particularly, the present invention relates to mountable and adjustable antenna apparatuses and methods for vehicles.

BACKGROUND ART

A common current vehicle antenna in the related art is an antenna rod which is fastened to a base in a ball and socket configuration, i.e., the ball is disposed at the proximal end of the antenna for universal pivoting on the socket which is mounted to the base. One such apparatus comprises a socket having a plurality of slots within which the antenna may be radially disposed by user-selection. Another apparatus is window-mountable and comprises an outer cover being disposed at the base of the antenna and having a cross section being elongated in the direction of the vehicle's travel, the cover including an enlarged section covering a loading coil for resisting bending of the antenna due to aerodynamic loads. The antenna is provided with a conductive base which engages a conductive pivot support. This antenna may be pivoted to a position proximate to the surface of the vehicle for resisting bending and later repositioned for optimizing reception of a signal.

Another related art invention involves a vehicle antenna rod support which comprises a foot portion being adapted for affixation to a base and a pivotal joint being therein mounted. The pivotal joint has a socket provided with a slot for receiving a cylindrical body for a rotary motion only in a direction transverse to the longitudinal axis of the foot portion. A terminal screw which forms the proximal end of the antenna rod projects through the slot and is threadably engaged into a diametrical bore of the cylindrical body. This cylindrical body has a cylindrical passage which extends transversely to the longitudinal axis of the foot portion. The cylindrical body is rotatably received in the passage only. A flange-style stop is affixed to the terminal screw outside the socket for being clamped against an external face of the socket upon threading the terminal screw into the bore. Yet another related art apparatus is directed toward a universal replacement antenna assembly for vehicles. An antenna mast is coupled to a mounting member having a lower body portion and an upper connecting portion. A plurality of rocker arms pivot from a lower end of the mounting member from an upright closed position to an open position, but never exceeding a range of 90 degrees from the closed position.

A related art satellite antenna apparatus comprises a pair of antenna assemblies being mounted in parallel on a rotatable platform. Each antenna assembly includes two sub-reflectors with a matching plastic element. The outputs of the two antenna assemblies are coupled with a single phase shifter. The combined outputs are retransmitted to a receiver which is located inside the vehicle. However, these related art antennas remain exposed to hazards, such as corrosion, accidental structural damage, vandalism, drag, fatigue, and flutter. Thus, a long-felt need is seen to exist for an antenna apparatus and a method which protects the antenna circuitry from such hazards.

DISCLOSURE OF THE INVENTION

The present invention mountable and adjustable antenna apparatus generally comprises a top housing member, a bottom housing member, and an antenna assembly being disposed within the top housing member. The top housing member is in a rotatable relation to the bottom housing member; and the antenna assembly is in a fixed relation to the top housing member. The top housing member comprises an aerodynamic configuration for reducing drag on, and for eliminating fatigue as well as flutter of, the antenna assembly. The aerodynamic configuration comprises a feature such as an airfoil-shaped cross-section, a span-wise taper, a span-wise linear taper, a back sweep, and a forward sweep.

The present invention method for mounting and adjusting an antenna apparatus generally comprises the steps of providing a top housing member, providing a bottom housing member, disposing and affixing an antenna assembly within the top housing member, and rotating the top housing member in relation to the bottom housing member, thereby adjusting the apparatus. The present method further comprises the step of providing the top housing member with an aerodynamic configuration for reducing drag on, and for eliminating fatigue as well as flutter of, the antenna assembly. The aerodynamic configuration providing step includes providing a feature such as an airfoil-shaped cross-section, a span-wise taper, a span-wise linear taper, a back sweep, and a forward sweep.

An advantage of the present invention is the protection of the antenna assembly, containing the delicate antenna circuitry, from corrosion, short-circuiting, fatigue, accidental damage, and vandalism. Other advantages include optimization of the signal transmission and the reduction of drag on, and the elimination of fatigue as well as flutter of, the antenna assembly. Further advantages include the enabling of rapid adjustment of the antenna assembly by the user and an omni-directional radiation pattern which allows any orientation of the antenna assembly without adversely affecting performance. Other features of the present invention are disclosed, or are apparent, in the section entitled "Modes for Carrying out the Invention," disclosed, infra.

BRIEF DESCRIPTION OF THE DRAWINGS

For a better understanding of the present invention, reference is made to the below-referenced accompanying Drawings. Reference numbers refer to the same or equivalent parts of the present invention throughout the several figures of the Drawings.

MODES FOR CARRYING OUT THE INVENTION

Figure 1:
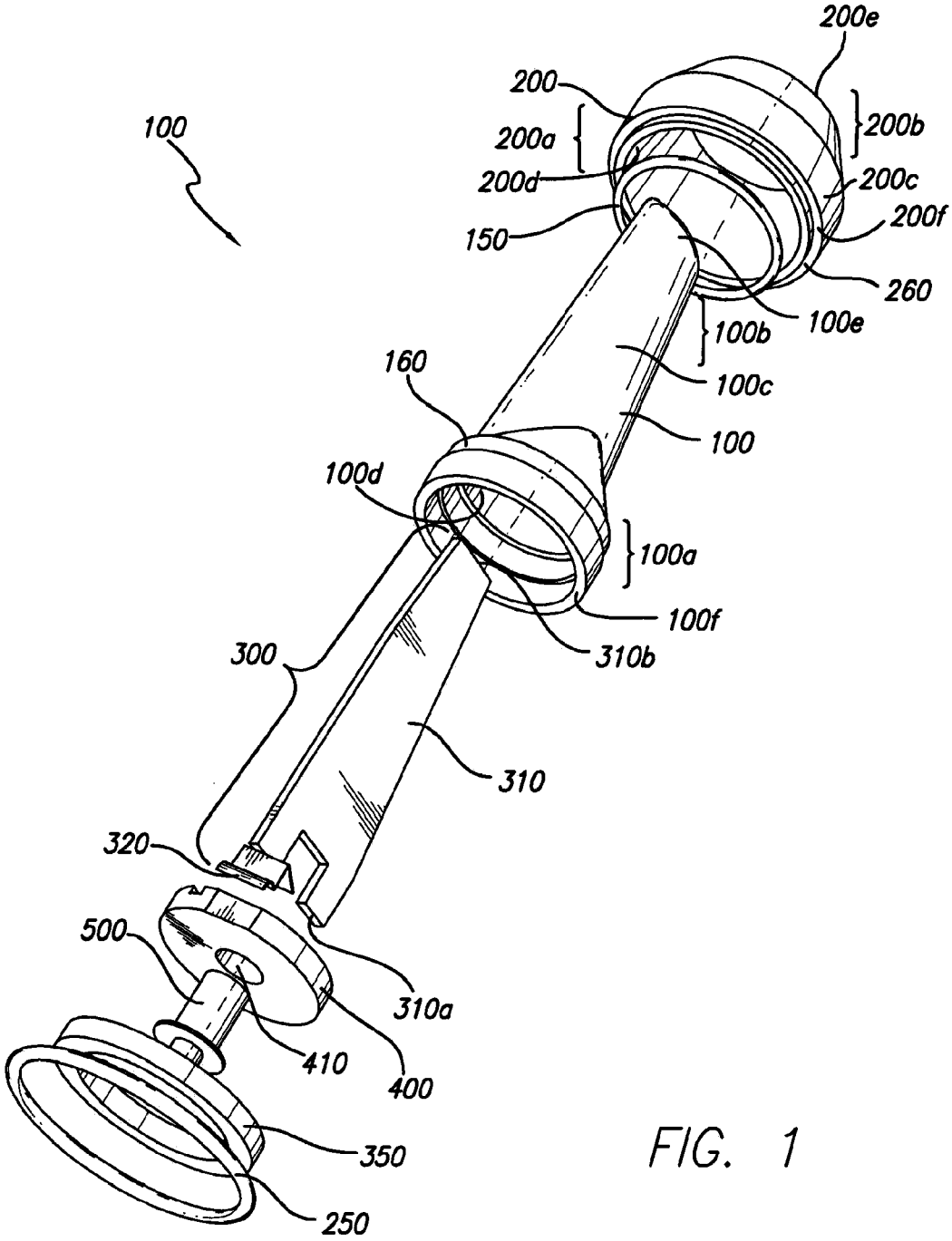
FIG. 1 is an exploded perspective view of a mountable and adjustable antenna apparatus, in accordance with the present invention.

FIG. 1 illustrates, in an exploded perspective view, a mountable and adjustable antenna apparatus 1000, in accordance with the present invention. The mountable and adjustable antenna apparatus 1000 comprises a top housing member 100, a bottom housing member 200, and an antenna assembly 300 being disposed within the top housing member 100. The top housing member 100 is in a rotatable relation to the bottom housing member 200; and the antenna assembly 300 is in a fixed relation to the top housing member 100. The top housing member 100 comprises an aerodynamic configuration for reducing drag on, and for eliminating fatigue as well as flutter of, the antenna assembly 300. The aerodynamic configuration comprises a feature such as an airfoil-shaped cross-section, a span-wise taper, a span-wise linear taper, a back sweep, and a forward sweep. The antenna assembly 300 comprises a printed circuit board (PCB) 310 having a proximal end 310*a* and a distal end 310*b*. The antenna assembly 300 further comprises a conductive leaf spring 320 mounted to the printed circuit board proximal end 310*a* for grounding the PCB 310. A base plate 400 is disposed within the bottom housing member 200 and has a tap hole 410. A conductive member 500 is disposed through the tap hole 410 for electrically and mechanically coupling the antenna member 300 to a receiver connector end, such as a receiver mount (not shown).

Still referring to FIG. 1, the top housing member 100 has a proximal end 100*a* and a distal end 100*b*, an outer surface 100*c* and an inner surface 100*d*, as well as a top surface 100*e* and a bottom surface 100*f*. Likewise, the bottom housing member 200 has a proximal end 200*a* and a distal end 200*b*, an outer surface 200*c* and an inner surface 200*d*, as well as a top surface 200*e* and a bottom surface 200*f*. A first seal 150 is disposed in a first seat 160 located on the top housing member outer surface 100*c*, the first seal 150 being also disposed between the top housing member outer surface 100*c*, at the top housing member proximal end 100*a*, and the bottom housing member inner surface 200*d*, at the bottom housing distal end 200*e*. A second seal 250 is disposed in a second seat 260 located on the bottom housing member bottom surface 200*f*, the second seal 250 also being disposed between the bottom housing member bottom surface 200*f* and a vehicle surface such as a car roof (not shown). The bottom housing member 200 comprises threading (not shown) formed on the bottom housing member inner surface 200*d* for facilitating mounting of the apparatus 1000 to a receiver connector end, the receiver connector end being disposed through a vehicle surface (not shown). A sealing member, such as a third seal 350, is disposed within the bottom housing member 200 between the base plate 400 and the receiver connector end (not shown). The respective seals 150, 250, 350 can be an element such as an O-ring, a washer, and a gasket and can be formed from an elastic material such as a silicone, a rubber, a fluorinated polymer, and an ethylenepropylenediene monomer (EPDM).

Figure 2:
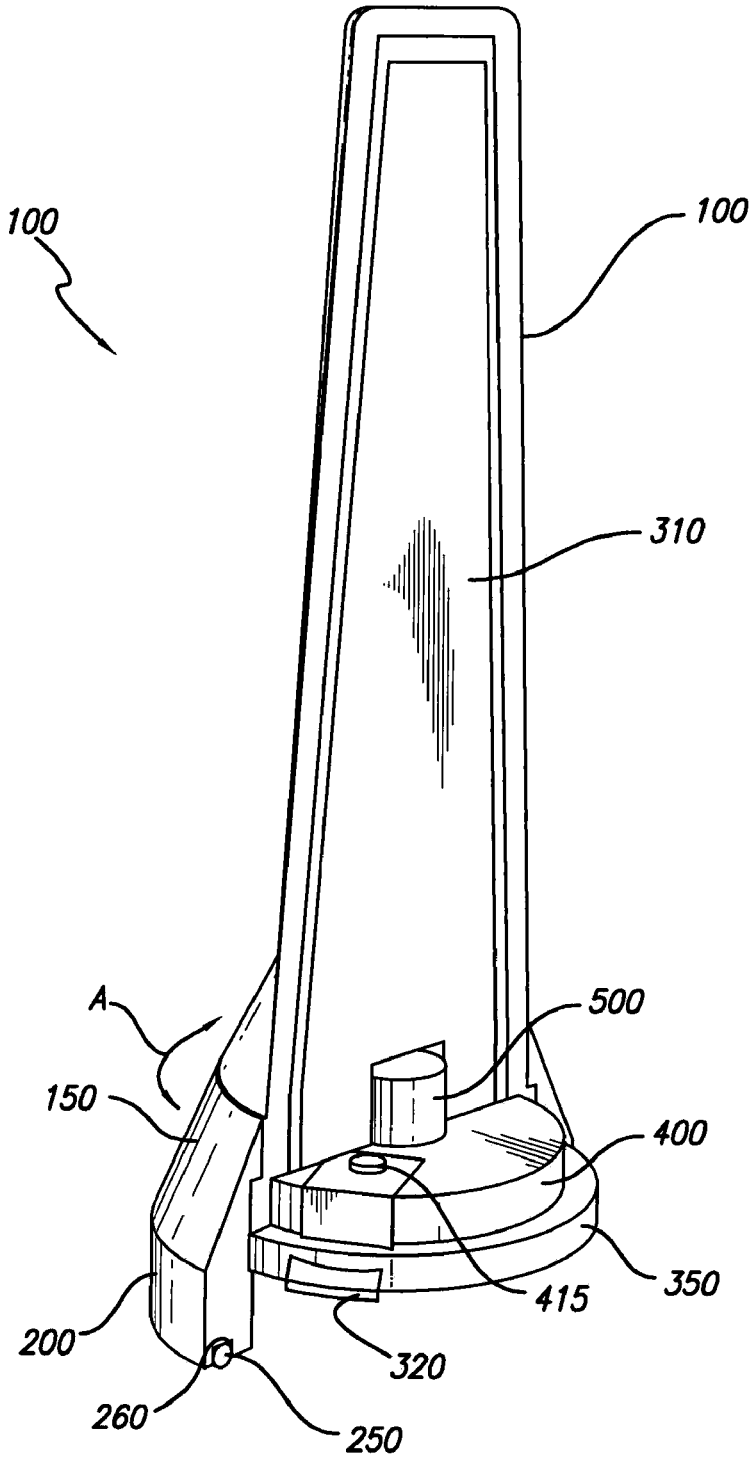
FIG. 2 is a cut-away perspective view of mountable and adjustable antenna apparatus, in accordance with the present invention.

FIG. 2 illustrates, in a cut-away perspective view, the mountable and adjustable antenna apparatus of FIG. 1, in accordance with the present invention. One end of the conductive leaf spring 320 is accommodated by a groove formed in the base plate 400 and is retained in position by a protuberance 415 formed in the base plate 400. A mid-portion of the conductive leaf spring 320 is disposed between the base plate 400 and the third seal 350 with the remaining end portion of the conductive leaf spring 320 being wrapped under the third seal 350, whereby grounding of the PCB 310 is effected. The top housing member 100 and the bottom housing member 200 each comprise a material such as a polymer and a composite material. The polymer can be an ABS plastic such as a molded ABS plastic or an injection molded ABS plastic. A tolerance between the top housing member 100 and the bottom housing member 200 comprises a range of approximately 0.290 inch to approximately 0.312 inch for facilitating rotation of the top housing member 100 in relation to the bottom housing member 200. The rotation comprises a range of approximately 0 degrees to approximately 360 degrees; and the rotation comprises a direction such as clockwise and counterclockwise.

The electrical characteristics of the antenna assembly 300 include a first frequency range of approximately 806 MHz to approximately 886 MHz as well as a second frequency range of approximately 2400 MHz to approximately 2500 MHz, a bandwidth of approximately 66 MHz @ approximately 2.0:1 VSWR corresponding to the first frequency range and a bandwidth of approximately 100 MHz corresponding to the second frequency range, a VSWR of approximately less than 2.0:1, a nominal gain of approximately 3 dBMEG, a maximum power of approximately 100 W, a nominal impedance of approximately 50 ohms, a nominal ground plane requirement of approximately 7 inches corresponding to the first frequency range and nominal ground plane requirement of approximately 2.5 inches corresponding to the second frequency range, an omni-directional radiation pattern, and a vertical polarization with field diversity.

The present method M of mounting and adjusting an antenna apparatus comprises the steps of providing a top housing member 100, providing a bottom housing member 200, disposing and affixing an antenna assembly 300 within the top housing member 100, and rotating the top housing member 100 in relation to the bottom housing member 200, thereby adjusting the apparatus 1000. The method M further comprises the step of providing the top housing member 100 with an aerodynamic configuration for reducing drag on, and for eliminating fatigue as well as flutter of, the antenna assembly 300. The aerodynamic configuration providing step includes providing a feature such as an airfoil-shaped cross-section, a span-wise taper, a span-wise linear taper, a back sweep, and a forward sweep.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, various changes and modifications in form, material, and fabrication material detail may be made without departing from the spirit and scope of the inventions as set forth in the appended claims and should be readily apparent to those of ordinary skill in the art. No claim herein is to be construed under the provisions of 35 U.S.C. § 112, sixth paragraph, unless the element is expressly recited using the phrase "means for."

INDUSTRIAL APPLICABILITY

The present invention industrially applies to antenna apparatuses and methods. More particularly, the present invention industrially applies to antenna apparatuses and methods for vehicles. Even more particularly, the present invention industrially applies to mountable and adjustable antenna apparatuses and methods for vehicles.

What is claimed:

1. A mountable and adjustable antenna apparatus, comprising:

a bottom housing member;

a top housing member being in rotatable relation to the bottom housing member, an antenna assembly being disposed within the top housing member and being in fixed relation to the top housing member, the antenna assembly comprising:

a printed circuit board having a proximal end and a distal end; and a conductive leaf spring mounted to the printed circuit board proximal end for grounding the printed circuit board, wherein an end of the conductive leaf spring is accommodated by a groove formed in a base plate and is retained in position by a protuberance formed in the base plate, and wherein a mid-portion of the conductive leaf spring is disposed between the base plate and a sealing member with the remaining end portion of the conductive leaf spring being wrapped under the sealing member, whereby grounding of the printed circuit board is effected.

2. An apparatus, as recited in claim 1, further comprising a base plate disposed within the bottom housing member and having a tap hole.

3. An apparatus, as recited in claim 2, further comprising a conductive member disposed through the tap hole for electrically and mechanically coupling the antenna assembly to a receiver connector end.

4. An apparatus, as recited in claim 1, wherein the top housing member has a proximal end and a distal end, wherein the top housing member has an outer surface and an inner surface, wherein the top housing member has a top surface and a bottom surface, wherein the bottom housing member has a proximal end and a distal end, wherein the bottom housing member has an outer surface and an inner surface, and wherein the bottom housing member has a top surface and a bottom surface.

5. An apparatus, as recited in claim 4, further comprising a first seal disposed in a first seat located on the top housing member outer surface, the first seal being also disposed between the top housing member outer surface, at the top housing member proximal end, and the bottom housing member inner surface, at the bottom housing distal end.

6. An apparatus, as recited in claim 4, further comprising a seal disposed in a seat located on the bottom housing member bottom surface, the seal being also disposed between the bottom housing member bottom surface and a vehicle surface.

7. An apparatus, as recited in claim 1, wherein the bottom housing member comprises an inner surface and threading formed on the bottom housing member inner surface for facilitating mounting of the apparatus to a receiver connector end.

8. An apparatus, as recited in claim 7, further comprising a seal disposed within the bottom housing member between a base plate and the receiver connector end.

9. An apparatus, as recited in claim 5, wherein the first seal comprises an element selected from a group consisting essentially of an O-ring, a washer, and a gasket, and wherein the first seal comprises an elastic material selected from a group consisting essentially of a silicone, a rubber, a fluorinated polymer, and an ethylenepropylenediene monomer.

10. An apparatus, as recited in claim 6, wherein the seal comprises an element selected from a group consisting essentially of an O-ring, a washer, and a gasket, and wherein the seal comprises an elastic material selected from a group consisting essentially of a silicone, a rubber, a fluorinated polymer, and an ethylenepropylenediene monomer.

11. An apparatus, as recited in claim 8, wherein the seal comprises an element selected from a group consisting essentially of an O-ring, a washer, and a gasket, and wherein the seal comprises an elastic material selected from a group consisting essentially of a silicone, a rubber, a fluorinated polymer, and an ethylenepropylenediene monomer.

12. An apparatus, as recited in claim 1, wherein the top housing member comprises a material selected from a group consisting essentially of a polymer and a composite material, and wherein the bottom housing member comprises a material selected from a group consisting essentially of a polymer and a composite material.

13. An apparatus, as recited in claim 1, wherein the top housing member is rotatable in relation to the bottom housing with a range of rotation comprising approximately 0 degrees to approximately 360 degrees, and wherein the top housing member is rotatable in relation to the bottom housing with a direction of rotation comprising a direction selected from a group consisting of clockwise and counterclockwise.

14. An apparatus, as recited in claim 1, wherein the top housing member comprises an aerodynamic configuration.

15. An apparatus, as recited in claim 14, wherein the aerodynamic configuration comprises at least one feature selected from a group consisting essentially of an airfoil-shaped cross-section, a span-wise taper, a span-wise linear taper, a back sweep, and a forward sweep.

16. An apparatus, as recited in claim 1, wherein the top housing member and the bottom housing member each comprise a material selected from a group consisting essentially of a polymer and a composite material.

17. An apparatus, as recited in claim 16, wherein the polymer comprises a plastic selected from a group consisting essentially of a molded ABS plastic and an injection molded ABS plastic.

18. An apparatus, as recited in claim 1, wherein the antenna assembly comprises a first frequency range of approximately 806 MHz to approximately 886 MHz, and wherein the antenna assembly comprises a second frequency range of approximately 2400 MHz to approximately 2500 MHz.

19. An apparatus, as recited in claim 18, wherein the antenna assembly comprises a bandwidth of approximately 66 MHz at approximately 2.0:1 VSWR corresponding to the first frequency range, and wherein the antenna assembly comprises a bandwidth of approximately 100 MHz at approximately 2.0:1 VSWR corresponding to the second frequency range.

20. An apparatus, as recited in claim 1, wherein the antenna assembly comprises a VSWR of approximately less than 2.0:1.

21. An apparatus, as recited in claim 1, wherein the antenna assembly comprises a nominal gain of approximately 3 dBMEG.

22. An apparatus, as recited in claim 1, wherein the antenna assembly comprises a maximum power of approximately 100 W.

23. An apparatus, as recited in claim 1, wherein the antenna assembly comprises a nominal impedance of approximately 50 ohms.

24. An apparatus, as recited in claim 1, wherein the antenna assembly comprises an omni-directional radiation pattern.

25. An apparatus, as recited in claim 1, wherein the antenna assembly comprises a vertical polarization with field diversity.

26. A mountable and adjustable antenna apparatus, comprising:

a top housing member;

a bottom housing member;

an antenna assembly being disposed within the top housing member, the top housing member being in rotatable relation to the bottom housing member, and the antenna assembly being in fixed relation to the top housing member, a printed circuit board having a proximal end and a distal end; and a conductive leaf spring mounted to the printed circuit board proximal end for grounding the printed circuit board, wherein an end of the conductive leaf spring is accommodated by a groove formed in a base plate and is retained in position by a protuberance formed in the base plate, and wherein a mid-portion of the conductive leaf spring is disposed generally between the base plate and a sealing member with the remaining end portion of the conductive leaf spring being wrapped generally under the sealing member, whereby grounding of the printed circuit board is effected, wherein the top housing member comprises an aerodynamic configuration, and wherein the aerodynamic configuration comprises at least one feature selected from a group consisting essentially of an airfoil-shaped cross-section, a span-wise taper, a span-wise linear taper, a back sweep, and a forward sweep.

27. A method of mounting and adjusting an antenna apparatus, comprising:

disposing and affixing an antenna assembly within a top housing member; and rotating the top housing member in relation to a bottom housing member, thereby adjusting the apparatus, wherein the antenna apparatus includes a printed circuit board having a proximal end and a distal end, and a conductive leaf spring mounted to the printed circuit board proximal end for grounding the printed circuit board, wherein an end of the conductive leaf spring is accommodated by a groove formed in a base plate and is retained in position by a protuberance formed in the base plate, and wherein a mid-portion of the conductive leaf spring is disposed generally between the base plate and a sealing member with the remaining end portion of the conductive leaf spring being wrapped generally under the sealing member, whereby grounding of the printed circuit board is effected.

28. A method, as recited in claim 27, wherein the top housing member has an aerodynamic configuration including at least one feature selected from a group consisting essentially of an airfoil-shaped cross-section, a span-wise taper, a span-wise linear taper, a back sweep, and a forward sweep.

* * * * *